US007795556B1

(12) United States Patent
Dean

(10) Patent No.: US 7,795,556 B1
(45) Date of Patent: Sep. 14, 2010

(54) PACKAGING APPARATUS

(76) Inventor: Edward T. Dean, 105 Valais Ct., New Bern, NC (US) 28562

( * ) Notice: Subject to any disclaimer, the term of this patent is extended or adjusted under 35 U.S.C. 154(b) by 1035 days.

(21) Appl. No.: 11/531,848

(22) Filed: Sep. 14, 2006

(51) Int. Cl.
*B07C 5/342* (2006.01)

(52) U.S. Cl. ..... 209/580; 198/698; 221/206; 53/244

(58) Field of Classification Search ..... 141/2, 141/83, 94, 98, 129; 209/580, 920; 53/244, 53/495; 198/698; 221/15, 206
See application file for complete search history.

(56) References Cited

U.S. PATENT DOCUMENTS 2,467,995 A * 4/1949 Schlechter ..... 221/15
3,139,713 A 7/1964 Merrill et al.
3,354,607 A * 11/1967 Lakso ..... 53/167
4,408,295 A * 10/1983 Kavage et al. ..... 250/559.4
4,674,259 A 6/1987 Hills
4,680,464 A * 7/1987 Bross ..... 250/223 R
5,522,512 A * 6/1996 Archer et al. ..... 209/580
6,185,901 B1 2/2001 Aylward
6,401,429 B2 * 6/2002 Aylward ..... 53/244
6,445,817 B1 * 9/2002 de la Torre-Bueno ..... 382/162
6,568,151 B2 * 5/2003 Buckley et al. ..... 53/240
6,799,413 B2 10/2004 Aylward

* cited by examiner

*Primary Examiner*—Timothy L Maust
(74) *Attorney, Agent, or Firm*—Chou IP & BioInformatic; Shui-Chou Chou

(57) ABSTRACT

An automated, continuous rotary-motion, positive-count, container-filling machine used for counting, color inspecting, geometric inspecting, and batching a predetermined quantity of multiple or discrete objects such as tablets, capsules, caplets, or packets of collated items (multiple objects to a pack). Apparatus comprises a plurality of rotary slats, each of which is independently driven, and able to pick up multiple objects at one location and deliver multiple objects simultaneously to a container through multiple counting and inspection devices.

4 Claims, 6 Drawing Sheets

PACKAGING APPARATUS

FIELD OF THE INVENTION

The present invention relates to high speed automated rotary packaging machines. The present invention can be used in a variety of packaging applications, but more particularly relates to automated packaging machines for filling container bottles with tablets. It can also be used in a variety of other packaging applications.

BACKGROUND OF THE INVENTION

Pharmaceutical products and associated packaging machines are typically subject to strict manufacturing guidelines. A variety of items, such as tablets, capsules, and the like, must be packaged to meet the minimum sterility requirements mandated by federal regulations. Items should be delivered and counted accurately such that the contents accurately reflect the claimed "count". It has been the goal of many manufacturers to provide a machine that can minimize the cost associated with operating the machines and provide the greatest ability to inspect the product just before it enters the final container.

In the past, many packaging machines utilized intermittent motion, wherein the movement of containers would be stopped during filling. Recently, many packaging machinery builders have turned to rotary designs for their high-speed equipment. Rotary designs offer higher throughputs and require less floor space.

Conventional pill-filling machines have taken on many different configurations and a variety of delivery and counting methods but with very little inspection. Generally, pill-filling machines utilize some common elements. Most use a rotary slat conveyor, commonly known as a "slat" in the industry, to pick up tablets from a hopper and delivery them to a container. The container to be filled is moved into position and is held stationary while the slat fills the container. Tablets filling the container pass through an optical device, which counts or otherwise analyses the product. In all of these configurations the tablets are delivered one at a time and the bottle is stationary while being filled.

In the past, pill-filling machines used a variety of methods to achieve the desired count. In U.S. Pat. No. 3,139,713, which is incorporated herein by reference, Merrill loads a certain amount of slats in one direction and turns the whole slat at one time. Merrill picked up many tablets from the first location, but delivered to the second location, each individual tablet. In U.S. Pat. No. 4,674,259, which is incorporated herein by reference, Hills proposes a similar method.

Recently, in U.S. Pat. Nos. 6,799,413 and 6,401,429, which are both incorporated herein by reference, Aylward proposed a similar method but also disclosed means for delivering the tablets on individual slats and thereby controlling the count more accurately. Aylward's U.S. Pat. No. 6,185,901, which is incorporated herein by reference, discloses an apparatus that picks up individual tablets and delivers individual tablets in one direction to the container and is thereby able to count each tablet individually.

All of these methods rely on the bottle being moved into position under the discharge chute. The bottle is stopped and held stationary, while the tablets are delivered individually. The slats are stopped once the count is reached; the filled bottles are then released, and empty bottles are moved into place as the cycle is repeated. Each method's throughput is dependent on the length of the screw and the number of tablets per container. Generally, the bottle count per minute does not exceed 400 bottles per minute.

The above methods have several characteristics that limit their utility. The slats move in only one direction, and the tablets are counted one at a time and are not inspected while counting. Also, all of the above methods utilize intermittent linear motion of the containers as opposed to continuous rotary motion.

SUMMARY OF THE INVENTION

The present invention addresses many of the shortcomings of the previous machines. An automated, continuous rotary-motion, positive-count, container-filling machine according to the present invention provides advantages in throughput, count accuracy, and product integrity. The present invention has a plurality of rotary slats, each of which is independently driven and able to pick up multiple objects at one location and deliver multiple objects simultaneously to a container through multiple counting and inspection devices.

In the present apparatus, the entire delivery assembly, including slats, tablets, and bottles, is rotated on a turret while counting and inspecting each tablet. In this method, the bottle count per minute can be increased by adjusting the speed of the turret or by increasing the number of loading stations. This apparatus is not speed restricted like the methods of the past because the present invention does not require that the bottles stop at a predetermined position before filling commences.

DETAILED DESCRIPTION OF THE PREFERRED EMBODIMENTS

Figure 1:
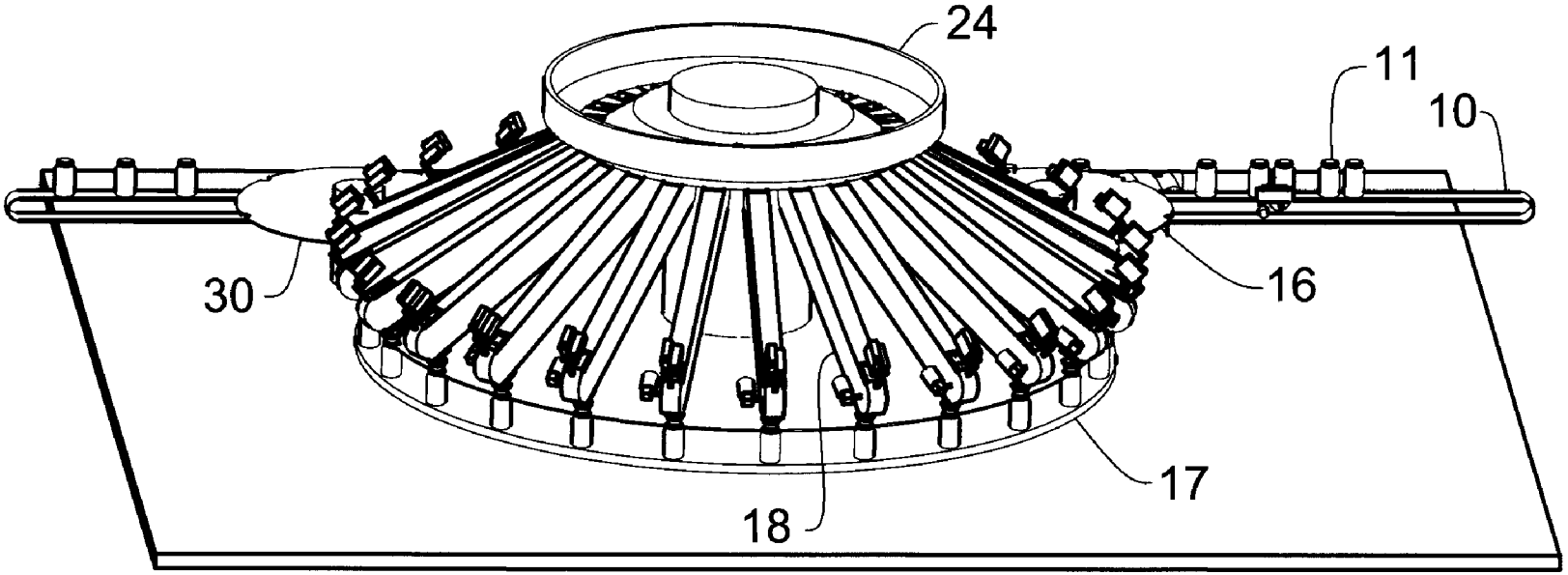
FIG. 1 is an isometric view of a preferred embodiment of the present invention.
Figure 2:
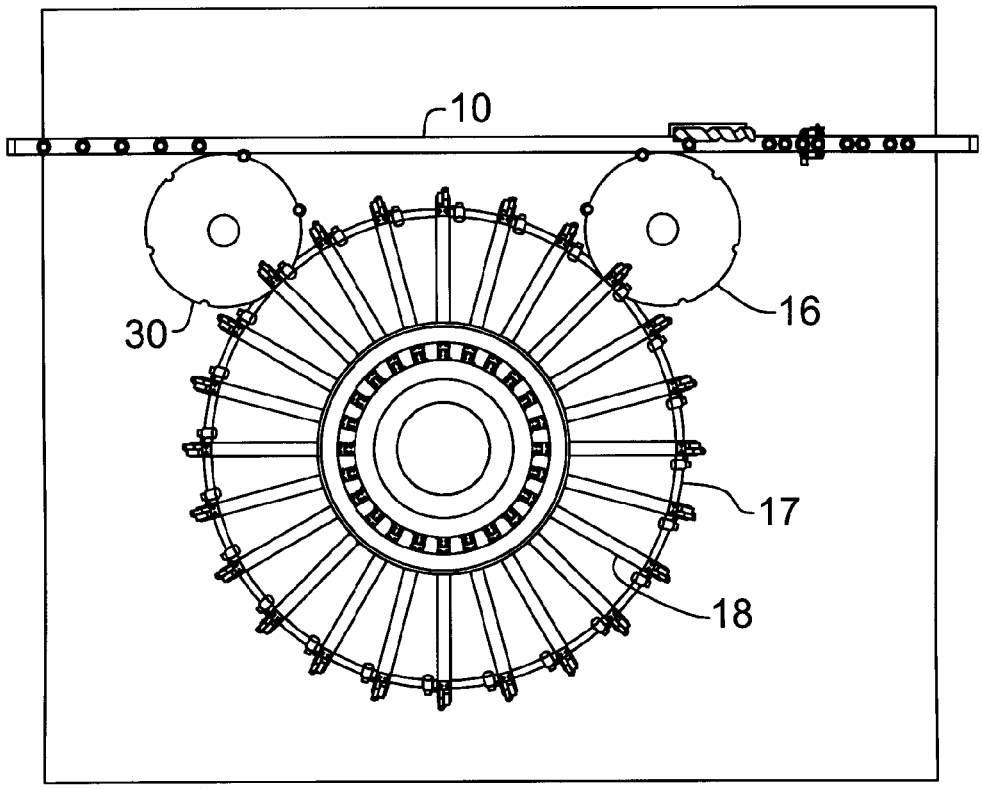
FIG. 2 is a plan view of a preferred embodiment of the present invention.
Figure 3:
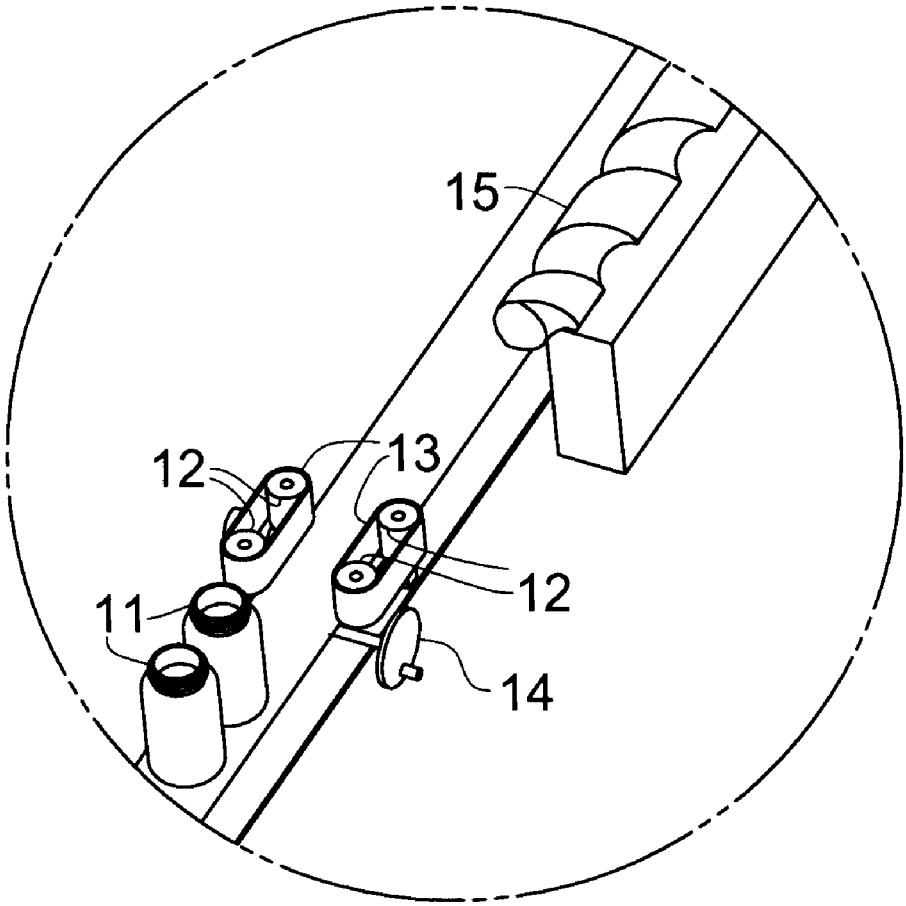
FIG. 3 is a view of a container gate system at the bottle in-feed section of the machine.

In the following description geometrical terminology such as horizontal and vertical etc. are employed throughout for convenience only and are in no way to be taken as limiting in either the specification or the appended claims. Also, the words "tablets" and "capsules" are used to indicate pharmaceutical products, but the claimed apparatus is also suitable for packaging a plurality of discrete units of other products in containers.

In a preferred embodiment, the apparatus incorporates a bottle conveyor 10 to bring empty containers 11 from the preceding process to the bottle pusher. The bottle pusher comprises a set of adjustable wheels 12, small belts 13, motor (not visible), and adjusting crank 14. The bottle pusher is adjustable to handle multiple bottle widths. The bottle pusher velocity is set to provide bottles at a rate greater than the overall machine capacity. This allows continuous pressure to be maintained on the bottles as they are pushed into the in-feed bottle screw 15.

The in-feed bottle screw rotates and draws bottles into the screw. As the screw turns, the threads of the screw increase in duration and allow each bottle to move inward to the screw and to a bottle-entry star wheel 16 having apertures to accommodate bottles. The bottles travel the screw length and enter the bottle-entry star wheel. The speeds of the bottle screw and bottle-entry star wheel are synchronized, thereby allowing the bottles to be handed off from the bottle screw to the bottle-entry star wheel.

The bottle-entry star wheel feeds bottles to a turret 17 carrying a plurality of bottle-filling assemblies known as slats 18.

Each slat is radial to the center of the turret rotation, with multiple slats extending to the outer circumference of the turret. A motor 19, gearbox 20, drive sprocket 21, idler sprocket 22, and conveyor belt 23 cooperate to transport discrete units of product from a hopper 24 to product container. The conveyor belt has at least one row of cavities 30 to accommodate units of product. Each slat runs independently from the other slats and can run in the forward direction or in the reverse direction. The conveyor belt may also be known as a chain.

Figure 4:
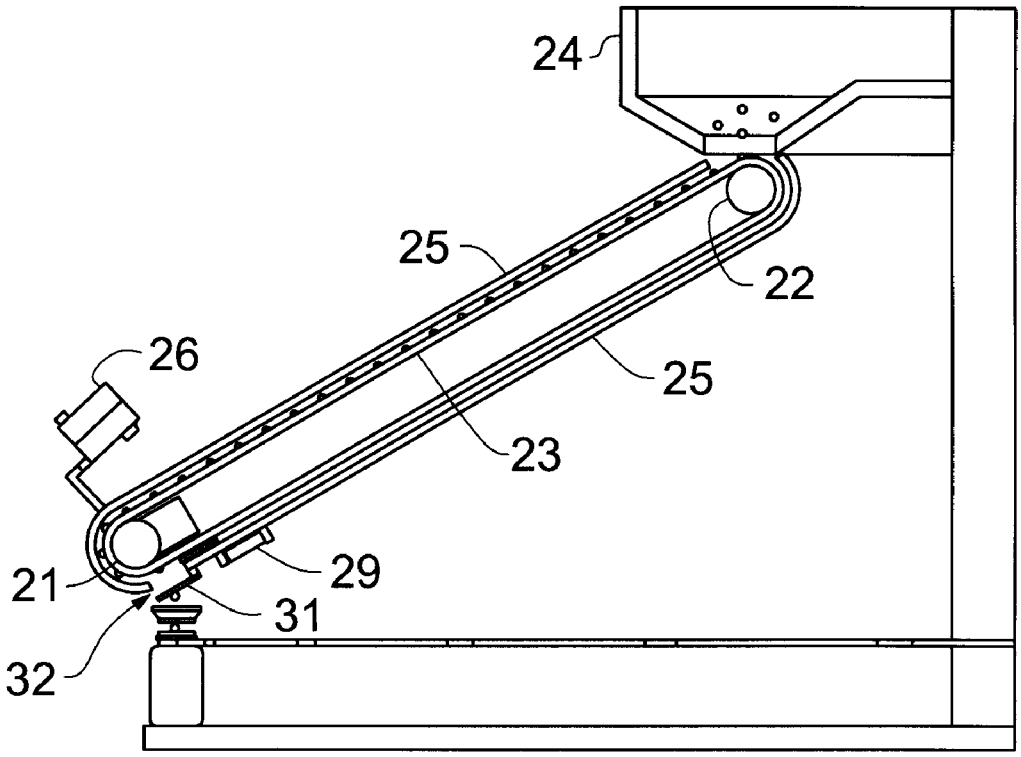
FIG. 4 is a side, elevational view in partial cross section of the apparatus of FIG. 1.
Figure 5:
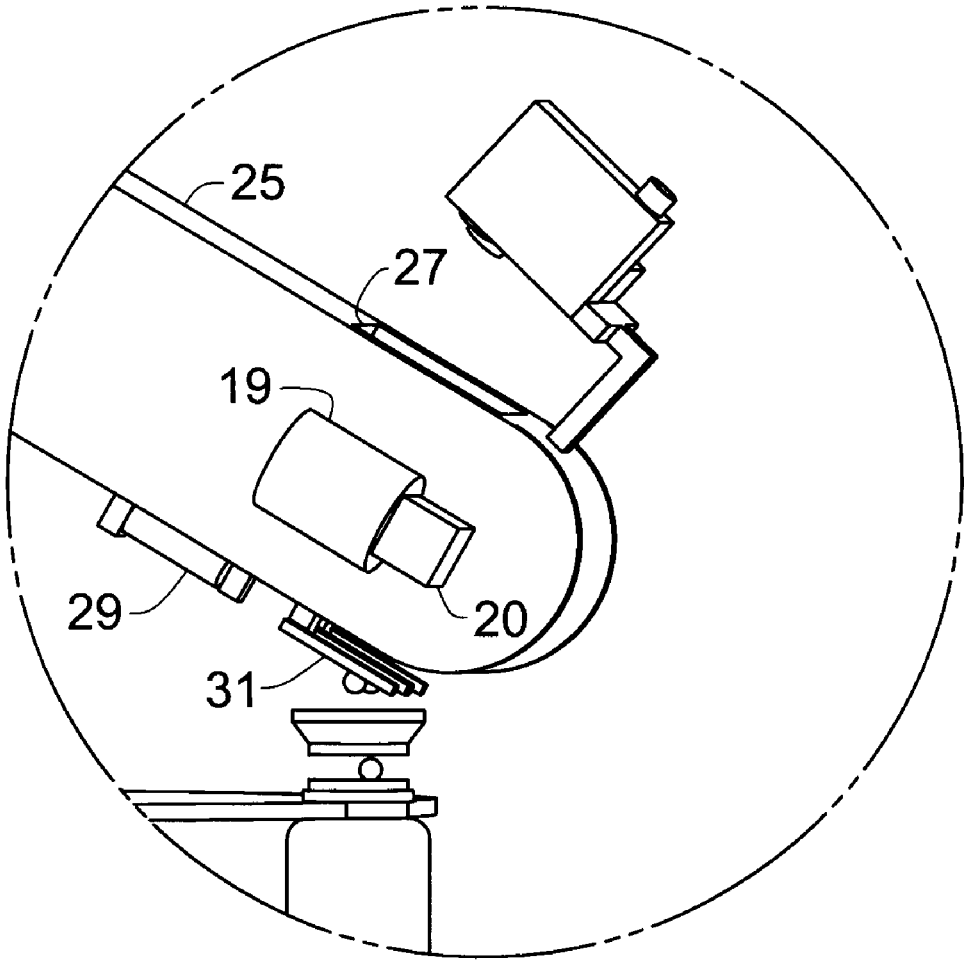
FIG. 5 is an enlarged view of the bottle-filling end of a slat.
Figure 6:
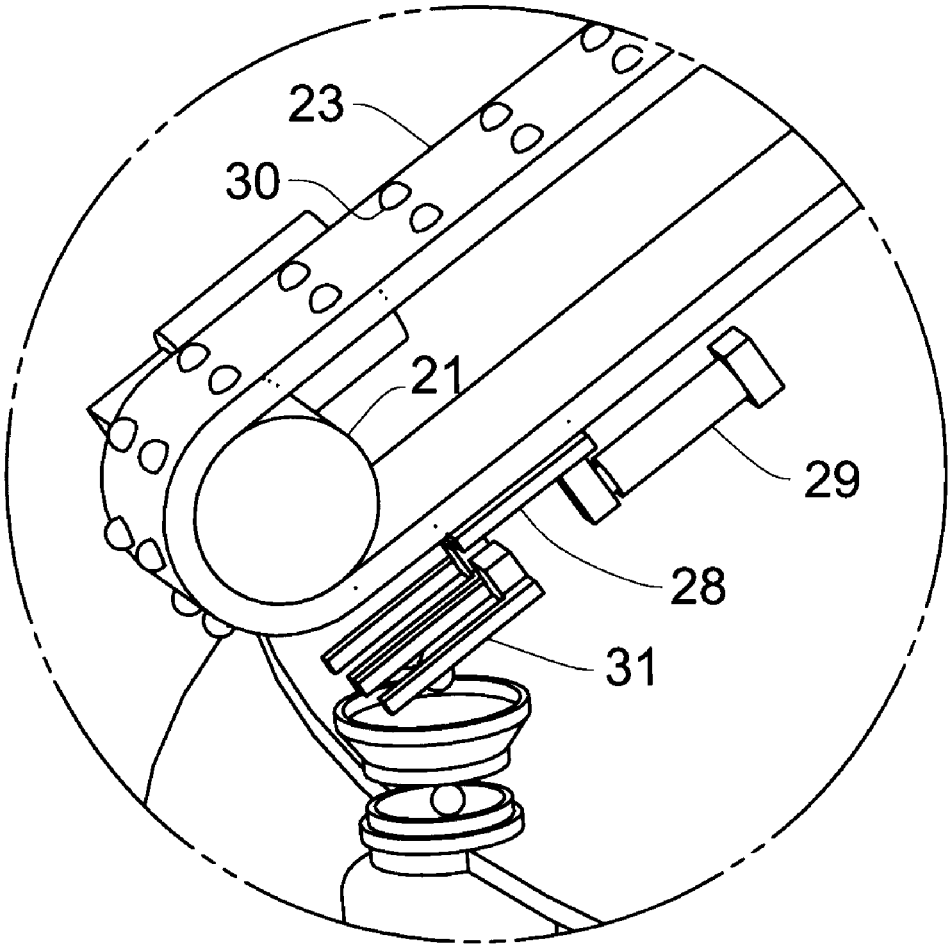
FIG. 6 is an enlarged view of the bottle-filling end of a slat with the covers removed.

Each slat includes a protective cover known as a slat guard 25, which encloses the inner conveyor components of the slat. The slat guard has two openings, a top opening 27 on the top of the outer end of the guard and a bottom opening 32 on the bottom of the outer end of the guard. The opening on the top is for one or more inspection devices 26 such as cameras, machine vision, and color sensors. Optionally, lighting is provided, as needed for the inspection devices. The bottom opening allows tablets to be released through a counting device 31. In a preferred embodiment, the counting device has one or more optical devices, known in the art, comprising a light emitting diode and a photodetector. The bottom opening is visible as a gap in the cross section of the slat guard 25 in FIG. 4.

A sliding blocking gate 28 is at the end of each slat. The sliding blocking gate is moved between the open and closed positions by actuating means 29, such as a solid state, electromechanical, or pneumatic actuator. As each slat nears the end of the count, the blocking gate is moved into place to block off all but one lane of tablets. The slat conveyor continues moving until the predetermined count is reached and then stops.

When first started, the apparatus begins filling the bottle-entry star wheel apertures with bottles; simultaneously, the product hopper is filled. Each container moves synchronously to the slat conveyor that will fill the container. One end of each slat conveyor is positioned beneath the hopper, which is continuously fed with tablets. As the desired tablet count is approached, the sliding blocking gate is engaged, thereby reducing the delivery rate to one tablet at a time. After the last tablet has been delivered, the filled bottle is released, and the slat conveyor is reversed so that any tablet that has passed the cover opening is loaded back into the first fill position. Alternatively, any tablets not released at the bottle fill location will continue to ride around the bottom of the slat conveyor and return to the conveyor fill location. The slat will continue to rotate with the turret, and as the star wheel accepts the next bottle, the blocking gate will retract and allow for the filling process to proceed.

In a preferred embodiment, the present invention uses multiple counting devices under each slat conveyor. In this way multiple tablets can be delivered at the same time to one bottle. As each bottle position is filled and the count reached, the slat conveyor will stop independently from any other slat conveyor, thereby allowing each slat to rotate and deliver tablets until each slat position is satisfied. It is not imperative that each cavity on each slat conveyor picks up a tablet on every revolution of the conveyor because the rotation will continue until the predetermined count is reached.

The present apparatus can also be direct coupled with the preceding and following processes by means of star wheel interfaces, thereby minimizing the manufacturing floor space required per machine.

As the bottles enter the bottle-entry star wheel they are drawn around the wheel, which is synchronized with the rotation of the turret. A sensor on the turret detects when the bottle has entered the turret. Once the bottle is in the turret, the corresponding slat conveyor is energized and tablets are filled into the bottle.

Each slat conveyor is energized independently from the other slat conveyors and moves the tablets from the tablet hopper to the bottle. The conveyor is housed inside a slat guard, which helps to keep the tablets lying down in the slat cavities. When the tablets reach the end of the slat guard an opening in the top of the end of the guard allows for color and geometric inspection of the tablets.

As the tablets traverse around the end of the conveyor the tablets are dropped through an opening at the bottom of the slat guard. The counting devices are located below the opening at the bottom of the slat guard. There is at least one counting device for each slat. In the preferred embodiment, there are at least two counting devices below the slat opening. Multiple counting devices allow for multiple tablets to be dropped simultaneously from the slat.

As the count of the container increases and the count approaches the predetermined count, a blocking gate will energize and block off all but one lane of tablets. The slat conveyor will continue to rotate until the predetermined count is reached. Once the predetermined count has been reached the slat will stop with the blocking gate still in position over all but one area of cavities.

Once the bottle has rotated to the bottle-exit star wheel 30, a sensor detects that the bottle has exited the turret and has passed to the bottle-exit star wheel. Optionally, the apparatus automatically evaluates the bottle count and characteristics such as dimension and color. If any bottles do not meet acceptance criteria, they are identified and can be sorted by subsequent accept/reject sorting conveyors known in the art.

What is claimed is:

1. A slat conveyor delivery system comprising:

a single container, a conveyor belt having n rows of cavities adapted to contain units of product, where n>1, and wherein said conveyor belt having n rows of cavities is adapted to deliver, at the same time, multiple units of the product to said single container, means for moving said conveyor belt along a looped path, means for limiting the discharge of units of product from said conveyor belt to one-at-a-time, at least two counting devices under said conveyor belt, thereby enabling simultaneous counting of multiple units of product as they are dropped from said conveyor belt to said single container.

2. The slat conveyor delivery system of claim 1 further comprising a color-sensing inspection device.

3. The slat conveyor delivery system of claim 1 further comprising an image sensing inspection device.

4. A method for packaging a predetermined number of product units in a container comprising:

providing the slat conveyor delivery system of claim 1, providing a plurality of product units to the slat conveyor delivery system, activating the slat conveyor delivery system, thereby continuously depositing product units into the container, n-at-a-time, while counting the deposited product units, when the count of deposited product units approaches the predetermined number of product units, activating means for limiting the discharge of units of product from each slat to one-at-a-time, when the count of deposited product units equals the predetermined number of product units, deactivating the slat conveyor delivery system.

* * * * *